US007418785B2

(12) United States Patent
Whitemiller et al.

(10) Patent No.: US 7,418,785 B2
(45) Date of Patent: Sep. 2, 2008

(54) COMPACT DISPENSING TUBE OPENER

(75) Inventors: Anthony F. Whitemiller, Lisle, IL (US); Ronald A. Angstead, Longmont, CO (US); Patrick M. Bertsch, Thornton, CO (US); Brent W. Murray, Longmont, CO (US)

(73) Assignee: Accurate Concepts, Inc., Naperville, IL (US)

( * ) Notice: Subject to any disclaimer, the term of this patent is extended or adjusted under 35 U.S.C. 154(b) by 26 days.

(21) Appl. No.: 11/369,407

(22) Filed: Mar. 7, 2006

(65) Prior Publication Data

US 2006/0162169 A1 Jul. 27, 2006

Related U.S. Application Data

(63) Continuation-in-part of application No. 11/041,133, filed on Jan. 24, 2005.

(51) Int. Cl.
*B26B 17/00* (2006.01)
*B26B 27/00* (2006.01)

(52) U.S. Cl. ..... 30/182; 30/90.1; 30/90.7; 30/92; 30/93; 81/9.4; 81/9.44; 131/248

(58) Field of Classification Search ..... 30/182, 30/113, 278, 109, 111, 280, 282, 90.1, 93, 30/90.7, 250, 261, 260, 252; 131/248, 250, 131/252, 253; 83/167, 545, 924, 620, 640; 81/9.4, 9.44
See application file for complete search history.

(56) References Cited

U.S. PATENT DOCUMENTS 311,053 A * 1/1885 Asbury ..... 30/109
346,453 A * 8/1886 Baldwin ..... 131/248
1,082,257 A * 12/1913 Astruck ..... 30/113
1,086,463 A * 2/1914 Robbins ..... 30/113
1,136,182 A 4/1915 Swift
2,659,517 A 11/1953 Reinhardt, Jr.
3,309,768 A * 3/1967 Thompson ..... 30/91.1
3,911,577 A 10/1975 Nickel
4,135,644 A 1/1979 Pacetti
4,158,914 A 6/1979 Kurtz
4,328,910 A 5/1982 Polite, Jr.
4,348,832 A 9/1982 Hauser
4,366,619 A * 1/1983 Bieganski ..... 30/90.1
4,493,437 A 1/1985 Breeden
4,516,322 A 5/1985 Schlein
4,597,179 A 7/1986 Goforth (Continued)

*Primary Examiner*—Ghassem Alie
(74) *Attorney, Agent, or Firm*—Harold A. Burdick

(57) ABSTRACT

A compact dispensing tube opener for accessing contents of a dispensing tube having a dispensing tip and an inner seal. The opener includes a housing with first and second passageways therein meeting at an angle at an intersection. A blade carriage is movable in the second passageway and across the intersection at one end thereof, a manually accessible portion at an opposite end thereof extending from the housing. A cooperative guide structure at the housing and the blade carriage maintains carriage slidability within the housing during use without binding. Return springs are maintained in the housing for returning the carriage after use. A dispenser tube tip locator is slidably maintained at the housing adjacent to an opening to the first passageway and has plurality of angled passages therethrough each with a different diameter. A lance is mounted at the housing for puncturing the seal, and is pivotable into and out of a channel defined crosswise in the housing.

20 Claims, 8 Drawing Sheets

U.S. PATENT DOCUMENTS 4,677,702 A * 7/1987 Cairns ..... 7/107
4,802,607 A 2/1989 Johnson
4,928,424 A * 5/1990 Campanelli et al. ..... 47/58.1 R
5,062,238 A * 11/1991 Smith et al. ..... 47/1.01 R
5,079,838 A 1/1992 Stallings, Jr.
5,782,154 A * 7/1998 Hansen ..... 83/167
5,911,573 A * 6/1999 Tsai ..... 431/253
D414,665 S 10/1999 Longo
5,992,022 A * 11/1999 Carrera Moya ..... 30/113
6,056,156 A 5/2000 Peng
6,058,606 A * 5/2000 Hepworth ..... 30/90.1
6,298,857 B1 * 10/2001 Schmidt ..... 131/250
2001/0032390 A1 10/2001 Davison
2005/0023301 A1 2/2005 Rumrill et al.

* cited by examiner

FIG. 16
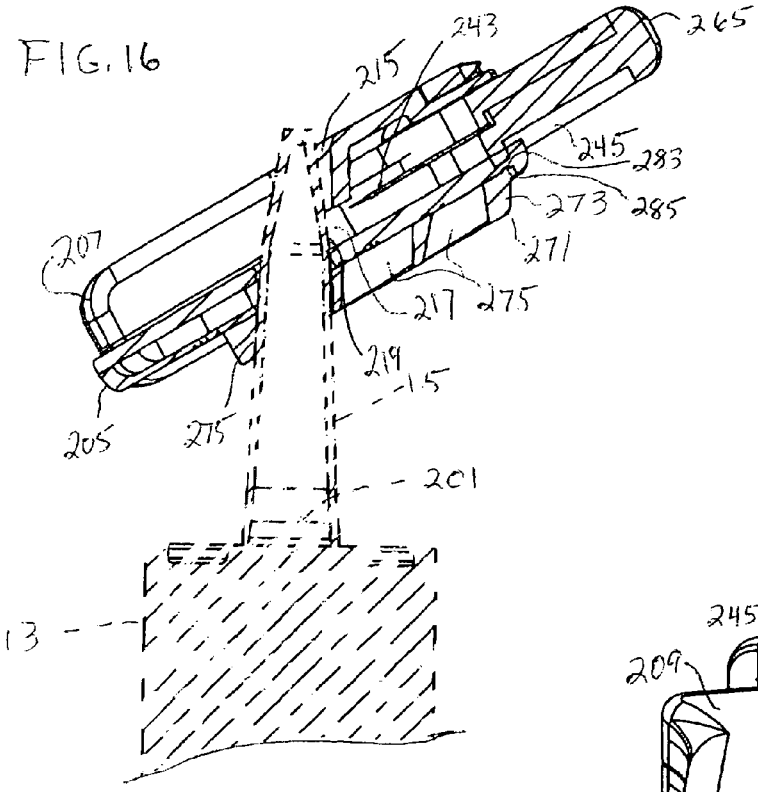
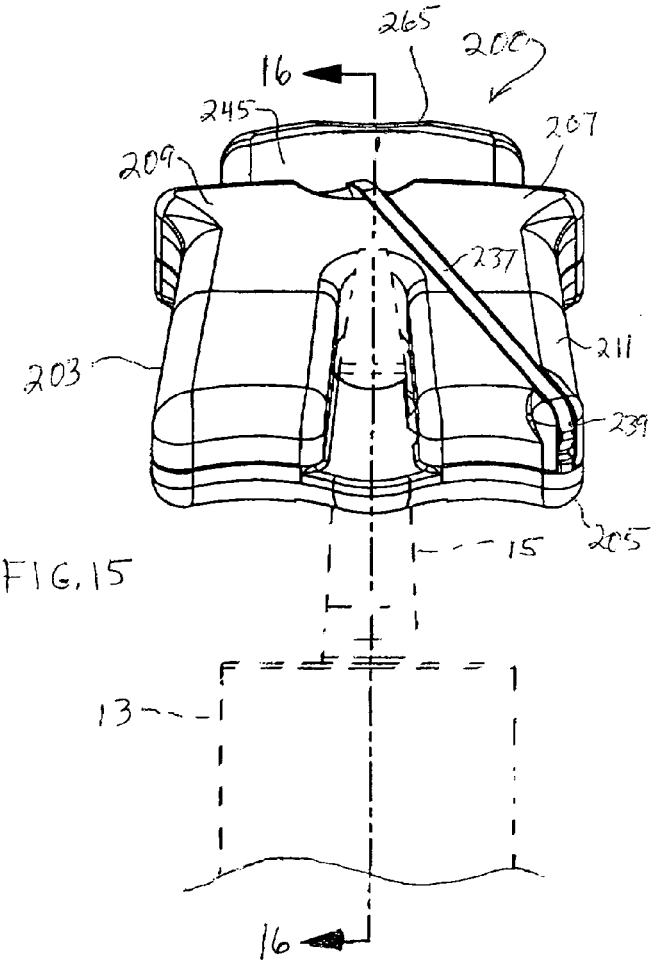
FIG. 15

COMPACT DISPENSING TUBE OPENER

FIELD OF THE INVENTION

This invention is a continuation-in-part of U.S. patent application Ser. No. 11/041,133 filed Jan. 24, 2005 by inventors herein and entitled DISPENSING TUBE OPENER.

FIELD OF THE INVENTION

This invention relates to openers for cylindrical tubes having a closed and sealed dispensing tip such as the type utilized for packaging and dispensing caulk or other sealants or adhesives, and, more particularly, relates to a compact cutter/opener for such dispensing tubes.

BACKGROUND OF THE INVENTION

Sealants such as caulk and adhesives are commonly provided in and dispensed from cylindrical tubes having a monolithic tapering (elongated conical, for example) plastic dispensing tip that is closed at its outermost tapered end upon delivery to an end user. Such tubes also commonly include a plastic/foil seal at the interface between the tube and dispensing tip. The dispensing tip must be cut and the foil seal punctured before any product can be dispensed from the device. Product then may be dispensed using a mechanical device that applies pressure at the back of the cylindrical tube opposite the tip, often referred to as a "caulk gun".

For aesthetic reasons, application of caulking or other sealants at various surfaces (around masonry, plumbing fixtures, windows and the like) requires precision to provide a bead of material having consistent width and/or depth and without surface blemishes. A properly cut dispensing tip on a caulk tube, for example, is preferably cut at a 45° angle at a location along the tip selected to provide a predetermined opening (and thus dispensed product) diameter. The cut must be without burrs to avoid striations or changes in shape of the applied bead. The foil seal must then be punctured to allow dispensing of the material in the tube.

Heretofore, such cuts were most often accomplished utilizing various knives, utility knives for example. Seal punctures were commonly produced by the nearest available lance, such as a nail or the like. Obtaining the desired tube cut (at the proper angle, linearity and without burrs) using such tools is difficult at best, and thus the desired degree of perfection in the application of the material bead is compromised. Such operations utilizing a utility knife are also hazardous for the worker.

Dedicated cutting tools or cutting markers for such purposes have heretofore been suggested and/or utilized, and have often been deployed together with a caulking gun (see U.S. Pat. Nos. 4,328,910, Des. 414,665, 4,158,914, 4,802,607, 6,056,156, 4,135,644 and 4,493,437. Such heretofore suggested dispensing tube cutting tools, however, have not always improved user safety or provided for selected tube tip opening diameter, angle precision or consistency and smoothness of cuts. Moreover, some tools heretofore suggested and/or utilized are often bulky and inconvenient or difficult to use (particularly when made part of a caulking gun). Larger tools are always subject to being laid down after use at a job site and forgotten and therefore not locatable when the next need arises. Tools that are difficult to use or time consuming in operation are soon abandoned to habitual use of older tools, even though the older tools may not provide the desired dispensing characteristics. The combination of a tool specifically adapted to provide repeatable, precision angled and located dispensing tube tip cuts and seal punctures, while being readily carried (in one's pocket, for example) by a user and thus ready for use as needed by a busy artisan, has not been heretofore suggested, and could be utilized.

Cutters have been suggested in different fields that provide for angled cuts of a stem or the like (for example, see U.S. Pat. Nos. 3,911,577, 4,928,424 and 4,348,832). Such items have not been used for cutting in fields presenting the same problems encountered when opening dispensing tubes of the type discussed herein, and thus are not readily adaptable to the task. Other cutters utilize a more compact sliding knife design for cutting articles such as cigar tips and wire leads, but again are not readily adaptable for the opening of dispensing tubes (see, for example, U.S. Pat. Nos. 1,086,463, 5,992,022 and 4,597,179). Further improvements could thus still be utilized.

SUMMARY OF THE INVENTION

This invention provides an opener for accessing contents of a dispensing tube having a monolithic dispensing tip that requires cutting, as well as a seal at the tip base that requires puncturing, to allow dispensing of material from the tube. The opener is user safe and allows for user selected tube tip opening diameter, cut angle precision and cut consistency and smoothness. The opener is compact (fitting in the user's palm and storing readily in a pocket or pouch), combining all necessary opening tools in a single form factor, and is thus more convenient and simple to use.

A now preferred embodiment of the compact dispensing tube opener of this invention includes a housing defining first and second passageways intersecting at an angle in the housing. The first passageway receives and stabilizes a selected length of the dispensing tip therein. At least one slide guide is located adjacent to the second passageway.

A blade carriage includes a blade receiving end maintained substantially entirely within the housing and a manually accessible portion extending from the housing. At least one guide for slidable movement of the slide guide of the housing is located thereat. A return mechanism (for example, a spring) is maintained in the housing and is operatively associated with the carriage for returning the carriage to a position with the manually accessible portion substantially fully extended from the housing.

The first passageway of the housing has first and second openings, the housing having a narrow cross-section between the first and second openings. A tip locator is movably retained adjacent to the first opening of the first passageway and has plural angled passages therethrough each with a different diameter. The locator passages are selectively movable into correspondence with the first opening of the first passageway.

The housing preferably includes a transverse channel extending crosswise in one side of the housing. A lance is pivotably mounted at the housing for puncturing the seal, and is pivotable into and out of the channel.

A second embodiment of the opener includes a housing having first and second elongated passageways intersecting therein at an angle. The first passageway has a span selected to receive and stabilize a length of the dispensing tip at a cutting location. A cutting utility is mounted for movement in the other passageway and has a cutting end preferably maintained substantially entirely within the housing, a user contactable portion thereof extending from the housing. The cutting end is located adjacent to the intersection with the first passageway, the user contactable portion being engageable by a user to move the cutting end across the first passageway.

The housing includes a matable structure adjacent to a first end of the first passageway. A locating collar (or collars) is receivable at the first end of the first passageway, a mating structure thereof engageable at the matable structure of the housing and configured for stabilization of the dispensing tip received in the first passageway at different user selected cutting locations along its length. A mechanism is maintained in the housing for returning the cutting utility to a position with the cutting end substantially withdrawn from the first passageway after a cut is made.

It is therefore an object of this invention to provide an improved compact dispensing tube opener for accessing contents of a dispensing tube having a monolithic dispensing tip that requires cutting, as well as a seal at the tip base that requires puncturing, to allow dispensing of material from the tube.

It is another object of this invention to provide an opener for accessing contents of a dispensing tube that is user safe and allows for user selected tube tip opening diameter, cut angle precision and cut consistency and smoothness.

It is another object of this invention to provide a compact combination tool specifically adapted to provide repeatable, precision angled and located, dispensing tube tip cuts and seal punctures, while being readily carried on the user and thus ready for use as needed.

It is still another object of this invention to provide an opener for accessing contents of a dispensing tube that fits into a user's palm and stores readily in a pocket.

It is yet another object of this invention to provide an compact opener for accessing contents of a dispensing tube that is convenient and simple to implement.

It is another object of this invention to provide a compact dispensing tube opener for accessing contents of a dispensing tube having a tip that requires cutting to allow dispensing of material from the tube, the opener including a housing defining first and second passageways intersecting at an angle in the housing, the first passageway for receiving and stabilizing a selected length of the dispensing tip therein and the second passageway having at least a first slide guide adjacent thereto, and a blade carriage having at least a first guide for slidable movement of the slide guide of the housing thereat, the carriage including a blade receiving end maintained substantially entirely within the housing and a manually accessible portion extending from the housing.

It is still another object of this invention to provide an opener for accessing contents of a dispensing tube having a dispensing tip that requires cutting to allow dispensing of material from the tube and an inner seal within the tube, the opener including a housing defining first and second passageways intersecting at an angle in the housing, the first passageway for receiving and stabilizing a length of the dispensing tip between first and second openings of the first passageway, the housing having a narrow cross-section between the first and second openings, a blade carriage slidably maintained at the second passageway of the housing and having a blade securing end and a manually accessible portion extending from the housing, and a tip locator movably retained adjacent to the first opening of the first passageway of the housing and having plural angled passages therethrough each with a different diameter and selectively movable into correspondence with the first opening of the first passageway.

It is yet another object of this invention to provide a compact dispensing tube opener for accessing contents of a dispensing tube having a dispensing tip and an inner seal, the opener including a compact housing having a first passageway extending between first and second openings, an intersection defined between the openings, the housing including a transverse channel extending crosswise in one side of the housing, a blade carriage movable across the intersection at one end thereof and having a manually accessible portion at an opposite end thereof extending from the housing, the blade carriage including at least a first guide for maintaining slidability of the carriage within the housing during use, a return maintained in the housing and operatively associated with the carriage for returning the carriage to a position with the one end substantially withdrawn from the intersection, a tip locator slidably maintained at the housing adjacent to the first opening of the first passageway and having plural angled passages therethrough each with a different diameter and selectively movable into correspondence with the first opening of the first passageway, and a lance pivotably mounted at the housing for puncturing the seal, the lance pivotable into and out of the channel.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 15 is a perspective view of the opener of FIG. 7 with a dispensing tube in place ready to be cut;

FIG. 16 is a sectional view taken through section lines 16-16 of FIG. 15.

DESCRIPTION OF THE INVENTION

Figure 1:
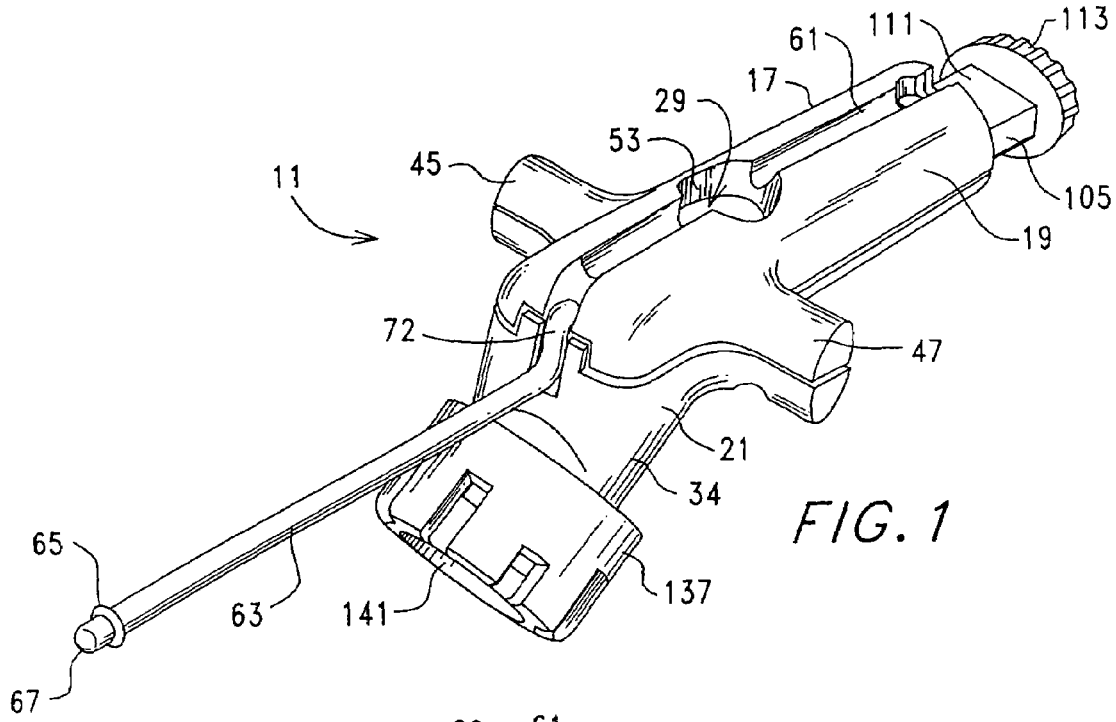
FIG. 1 is a perspective view of a first embodiment of the dispensing tube opener of this invention.
Figure 2:
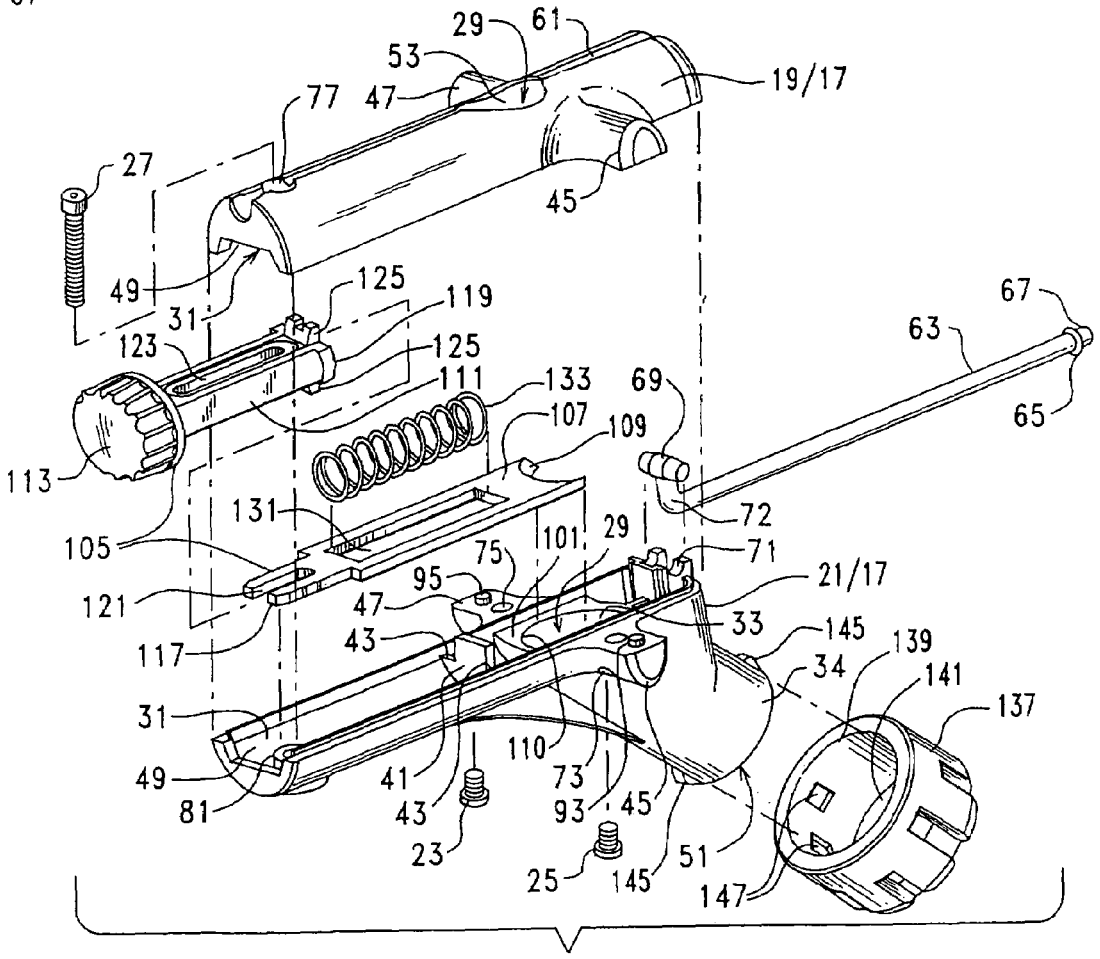
FIG. 2 is an exploded perspective view of the opener of FIG. 1.
Figures 3, 4:
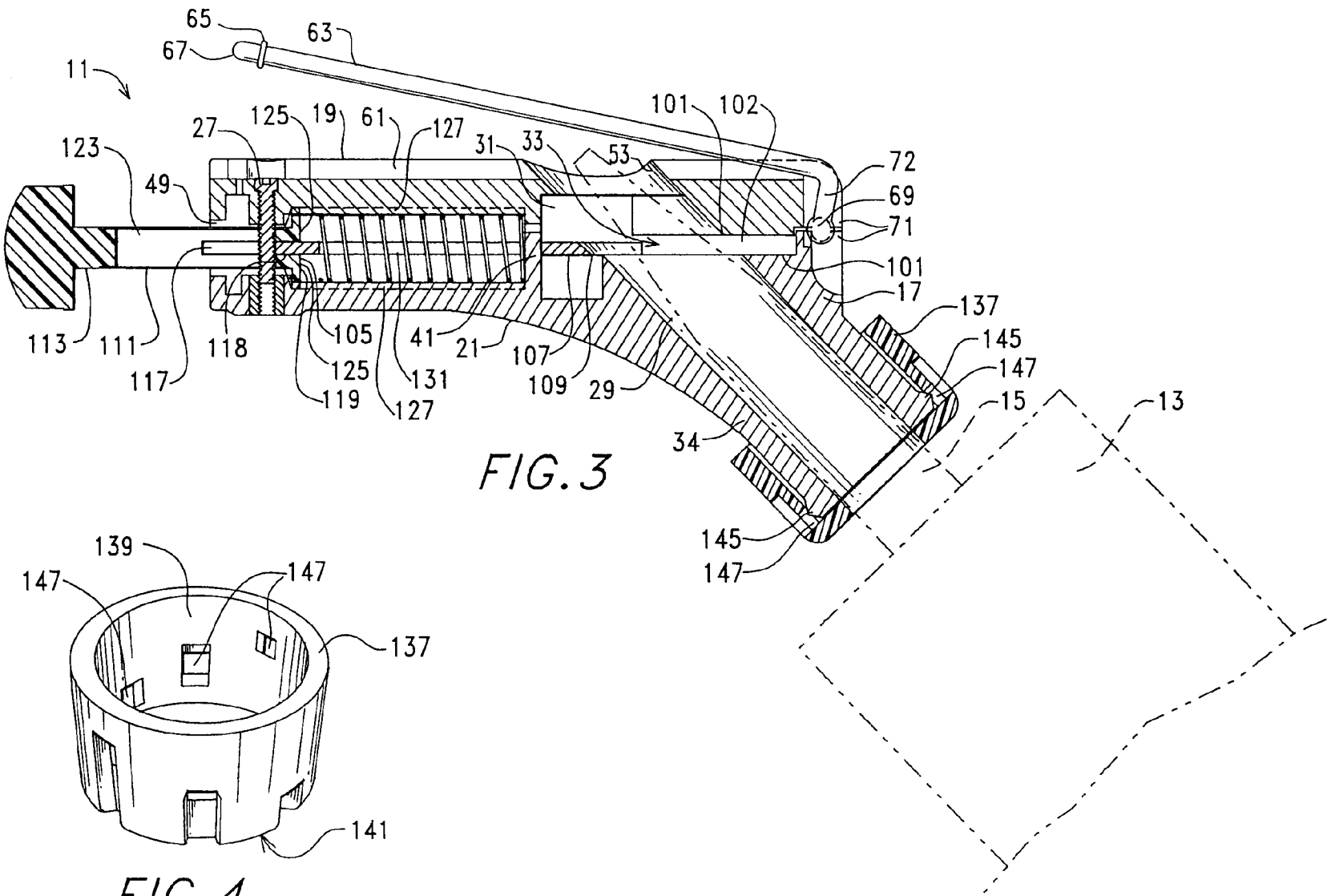
FIG. 3 is a sectional view of the opener of FIG. 1 illustrating operation of the opener to cut a dispensing tip of a cylindrical dispensing tube.
FIG. 4 is a perspective view of the depth adjustment collar utilized with the opener of FIG. 1.

Referring to FIGS. 1 through 3, a first embodiment 11 of the opener of this invention is illustrated. The opener is configured for accessing the contents of a dispensing tube 13 of the type having a monolithic dispensing tip 15 that requires cutting to allow dispensing of material from the tube (see FIG. 3). Such tubes, common in the trades pertaining to caulking and sealing, also typically have an inner foil seal that must also be punctured in order of material to be dispensed.

Opener 11 includes a housing 17 formed from upper and lower housing sections 19 and 21, respectively, the housing sections secured by threaded connectors 23, 25 and 27. First and second elongated passageways 29 and 31, respectively, are defined through housing 17 by the interior configurations of housing sections 19 and 21 and meet at intersection 33 within the housing (see especially FIG. 3). Housing section 21 includes angled portion 34 defining the greater part of passageway 29. Passageways 29 and 31 intersect at an angle at intersection 33, the angle selected to accommodate angled cutting of dispensing tip 15 (in the range of from 15° to 80° relative to the axis defining dispensing tip length, and preferably 45° as shown herein, though other models can be configured for different cutting angles).

Length of span of passageway 29 is selected to receive a selected length of dispensing tip 15 therethrough and stabilize the dispensing tip at a cutting location at intersection 33. Housing section 21 includes abutment 41 having guides 43 positioned laterally thereof (similar guides are correspondingly positioned at housing section 19, but without a corresponding abutment). Both housing sections 19 and 21 are configured to provide finger engageable housing extensions 45 and 47 at each side of housing 17 which are engageable by a user's finger during use as will become apparent. Opening 49 from housing 17 is formed at one end of passageway 31 by the configuration of housing sections 19 and 21 (the other end of passageway 31 terminating at or near intersection 33). Openings 51 and 53 from housing 17 (at each end of passageway 29) allow movement of dispensing tip 15 through the passageway as shown in FIG. 3.

Channel 61 along the length of the exterior of housing section 19 is provided for storage of lance 63 when lance 63 is not in use. Lance 63 is provided for puncturing the foil seal internal of may dispensing tubes, and includes an enlarged collar 65 at puncture end 67 thereof to enhance puncture efficacy. Lance 63 includes integral pivot 69 held at hub structure 71 formed by structure at each of housing sections 19 and 21. Leg 71 of lance 63 accommodates pivoting of lance 63 into and out of channel 61.

As shown in FIG. 2, openings 73, 75 and 77 are provided in housing 17 to receive and retain the threaded connectors. Connectors 23 and 25 are received by threaded openings at extensions 47 and 45, respectively, of housing section 19 (not shown), and connector 27 is received by threaded post 81 at housing section 21. Pins 93 and 95 at extensions 45 and 47 of housing section 21 are receivable in corresponding openings at extensions 45 and 47 of housing section 19 to aid alignment retention between housing sections. Guide surface 101 is defined at housing section 21 adjacent to intersection 33 (a corresponding guide surface is defined at housing section 19 adjacent to opening 53). For reasons that will become apparent as this description proceeds, the various guides and guide surfaces at housing sections 19 and 21 are dimensioned and located so that gap 102 is defined between the guides and guide surfaces at housing section 19 and the corresponding ones of the guides and guide surface at housing section 21 (as shown between guide surfaces 101 in FIG. 3, it being understood that a similar gaps exist between corresponding guides 43).

Cutting utility 105 is mounted for linear movement in at passageway 31 of housing 17, and includes slide 107 having a cutting end 109 (preferably having a concave cutting surface thereat, the concavity substantially matching arc 110 defined by the entry at intersection 33 of passageway 29) thereat and plunger 111 having a user contactable portion 113 thereat. Cutting end 109 is maintained entirely within housing 17 thus enhancing user safety. One end of plunger 111 including portion 113 extends through opening 49 from the housing 17. Plunger 111 and slide 107 are friction fit to one another with spread fork 117 receivable into slot 118 at end 119 of plunger 111. Slot 121 at fork 117 and slot 123 in plunger 111 are provided to receive connector 27 therethrough to further secure plunger 111 within the opener and define the extent of travel of utility 105 in passageway 31 (see FIG. 3). End guides 125 of plunger 111 are guided on tracks 127 of adjacent passageway 31 at each of housing sections 19 and 21 (see FIG. 3).

Slide 107 of cutting utility 105 has slot 131 therein receivable over abutment 41. Slide 107 is smoothly transported between corresponding guides 43 and guide surfaces 101 at housing sections 19 and 21 in gap 102 thus maintaining, in cooperation with the stable location of fork 117 in slot 118 of plunger 111, alignment of slide 107 and thus the cutting surface of cutting end 109 thereof. Return spring 133 is maintained in slot 131 with one end thereof contacting abutment 41 and the other end contacting the end of slot 131 (other means of biasing cutting utility 105 could be utilized at would be apparent). In use, this arrangement assures return of cutting utility 105 to a position with plunger 111 fully extended from housing 17 and with cutting end 109 substantially withdrawn from passageway 29 after movement by a user to cut a dispensing tip (with the user engaging contactable portion 113 to move cutting end 109 across passageway 29 having a dispensing tip selectively located thereat).

Turning now to FIG. 4, locating collar 137 is provided for user adjustment of the effective length of passageway 29 thereby accommodating stabilization of dispensing tip 15 at different user selected cutting locations along the length of the dispensing tip. Collar 137 includes mounting opening 139 and dispensing tip receiving opening 141 and is mountable at mounting opening 139 at the end of angled portion 34 of housing section 21. Housing section 21 includes at least one protuberance 145 (preferably two) at the end thereof. Plural mating notches 147 (preferably three for each provided protuberance 145) are arrayed at an interior portion of collar 137 at different depths relative to receiving opening 141.

Engagement (as shown in FIG. 3) of protuberances 145 with opposing selected notches 147 secured collar 137 a selected distance from the intersection 33. By twisting collar 137 to achieve engagement of a different pair of notches 147 at protuberances 145 (the different pair at a different depth relative to receiving opening 141) a different distance is achieved to intersection 33, thus effectively adjusting the length of passageway 29 and defining a new cutting location along the length of an inserted dispensing tip 15 (for tips of the same size). The three notch pair depth locations preferred, when used in association with commonly sized dispensing tube tips, correspond to a dispensing tip opening size after cutting of 0.5", 0.25" or 0.125" depending upon notch 147 pair selection.

It should be realized that the use of protuberances and notches as shown could be reversed (with a notch of notches located at housing 17 and a protuberance of protuberances located at collar 137. Moreover, as an alternative to collars having multiple, different depth notches, plural collars could be provided each one having a single notch pair at a different depth with respect to others of the plural collars.

Figure 5:
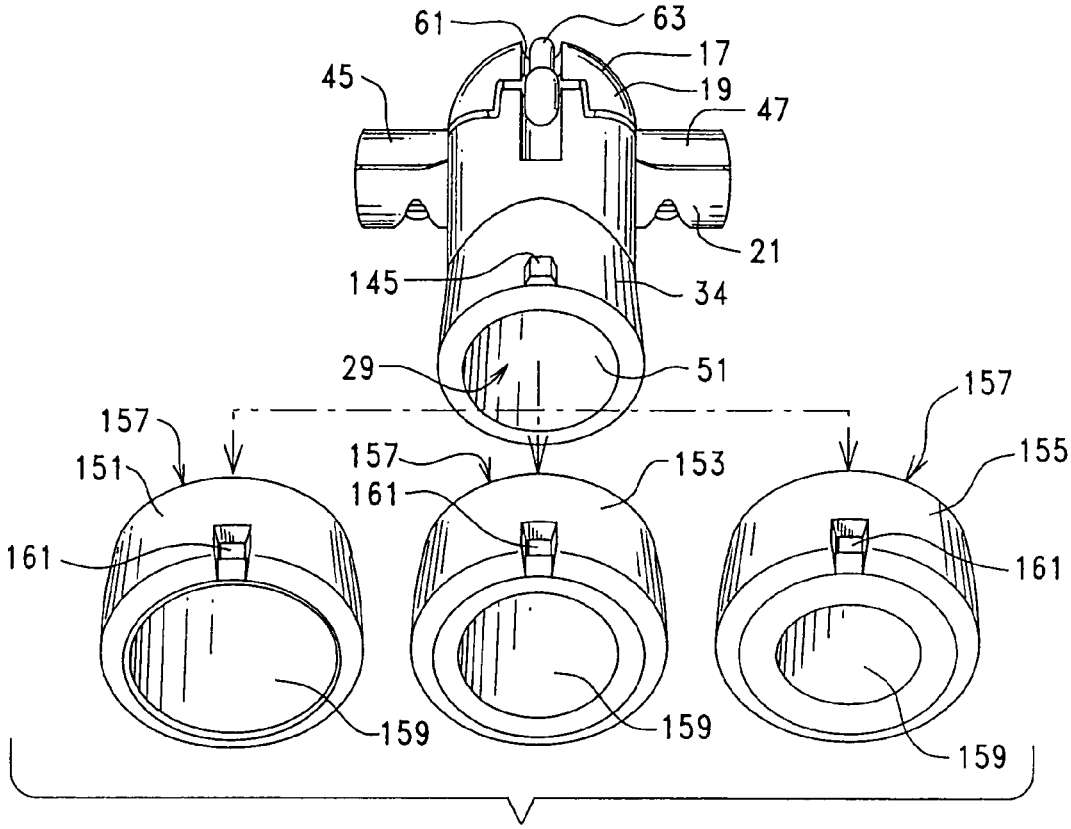
FIG. 5 is an end view illustrating a second embodiment of the opener of this invention employing plural collars each configured to achieve a different dispensing opening diameter.

A first alternative embodiment of this invention is illustrated by FIG. 5 wherein user adjustment of cross-section of at least a segment of passageway 29 to accommodate different user selected cutting locations is accomplished by providing plural locating collars 151, 153 and 155 (for example) each having mounting opening 157 and a dispensing tip receiving opening 159 and each separately mountable at mounting opening 157 at the end of angled portion 34 of housing section 21. As before housing section 21 includes at least one protuberance 145 at the end thereof. An equal number of notches 161 (equal in number to protuberance 145 are provided at each collar for securement of the collars on the end of angled portion 34 engaging protuberance 145. In each of collars 151, 153, and 157 one of mounting opening 157 or receiving opening 159 has a different selected internal diameter relative to the other of plural collars.

This means limits extent to which a tapered dispensing tube tip 15 is allowed entry into passageway 39 (different amounts for different ones of the collars) thereby defining different cutting locations along the length of an inserted dispensing tip 15 (for tips of the same size) depending on the collar selected. The three collars preferred, when used in association with commonly sized dispensing tube tips, have internal diameters corresponding to a dispensing tip opening size after cutting of approximately 0.375", 0.25" or 0.125" depending upon the collar selected.

Figure 6:
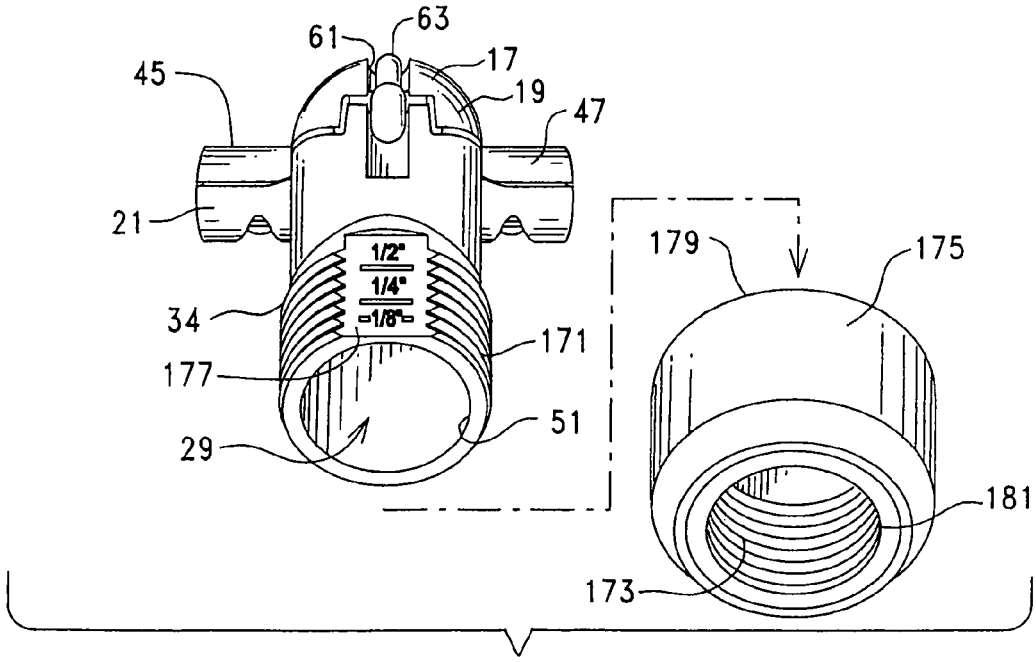
FIG. 6 is an end view of still another embodiment of the opener of this invention employing a threaded design at the collar interface for selective dispensing opening diameter.

A second alternative embodiment of this invention is illustrated by FIG. 6 wherein user adjustment of the effective length of passageway 29 to accommodate different user selected cutting locations is accomplished by providing a threaded portion 171 at the end of angled portion 34 of housing section 21 for engaging mating threaded section 173 at locating collar 175 (the internal and external thread configurations could be reversed). Indicator/gauge 177 is located at threaded portion 171 and is calibrated to show the different positions a user should use when threading collar 175 onto threaded portion 171 to locate end 179 (adjacent to the mounting opening thereof) of collar 175 to achieve a selected dispensing tip opening size after cutting (0.5", 0.25" or 0.125", for example).

Thus by threading collar 175 to move the collar up or down relative to indicator 177 a different distance is achieved to between intersection 33 and dispensing tip receiving opening 159 181, thus effectively adjusting the length of passageway 29 and defining a new cutting location along the length of an inserted dispensing tip 15 (for tips of the same size).

The openers of this embodiment of the invention are preferably of a size selected so that contactable portion 113 is engageable in a hand of the user and moveable thereby in cooperation with fingers of the same hand engaging housing extensions 45 and/or 47, thereby to effect cutting movement of cutting end 109 of cutting utility 105. The preferred dimensions are thus about 5" long and 2" or less wide (at angled portion across finger grip extensions 45 to 47), with housing 17 at passageway 31 being less than about 1" in diameter.

FIGS. 7 through 15 illustrate the now preferred embodiment 200 of the opener of this invention. As before, the opener is configured for accessing the contents of a dispensing tube 13 of the type having a monolithic dispensing tip 15 that requires cutting and an inner foil seal 201 that must be punctured to allow dispensing of material from the tube (see FIGS. 15 and 16).

Figure 12:
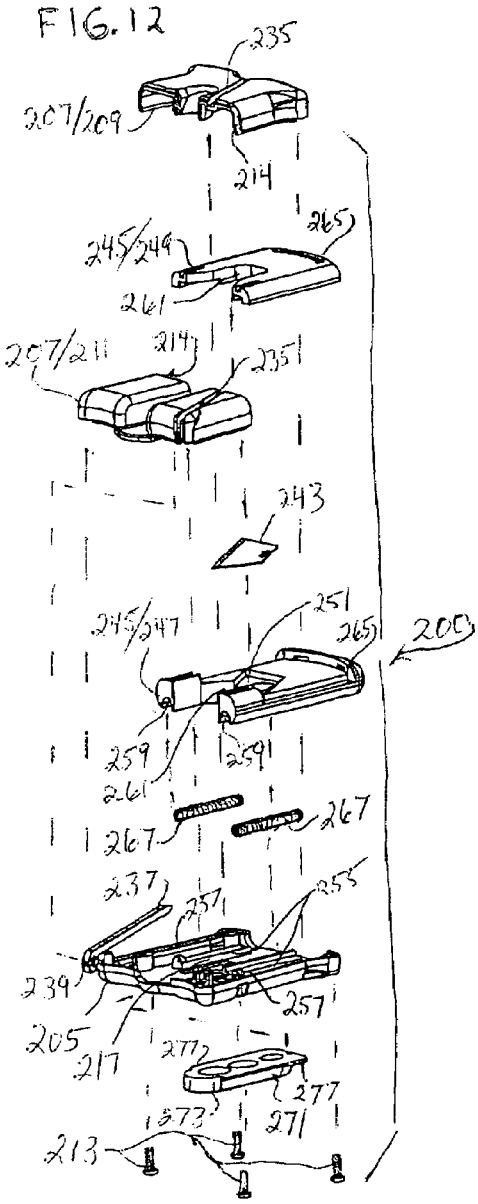
FIG. 12 is an exploded perspective view of the opener of FIG. 7.
Figure 13:
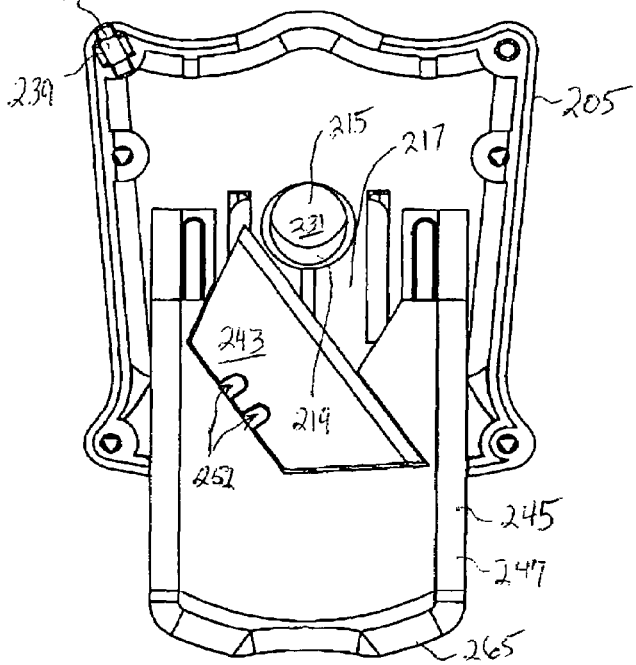
FIG. 13 is a plan view of one half of the opener of FIG. 7 with the housing open.
Figure 14:
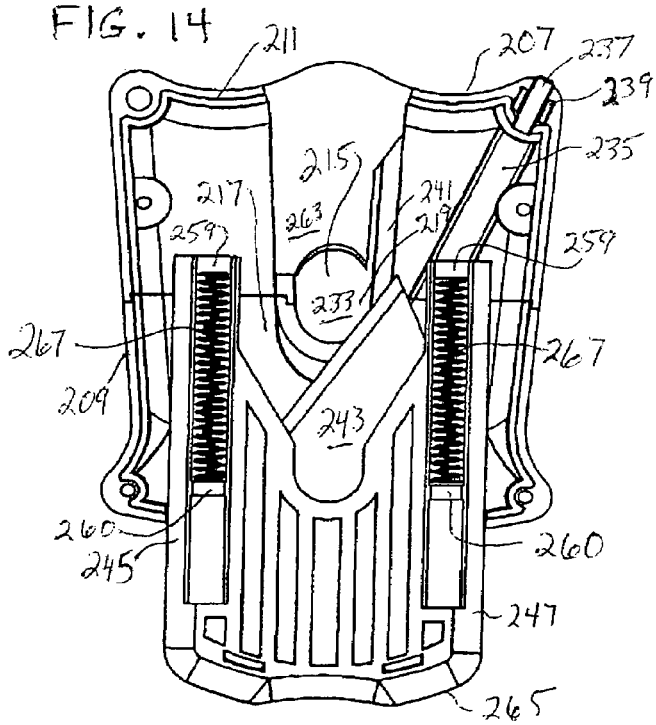
FIG. 14 is a plan view of an opposite half (with respect to FIG. 13) of the opener of FIG. 7 with the housing open.
Figure 18:
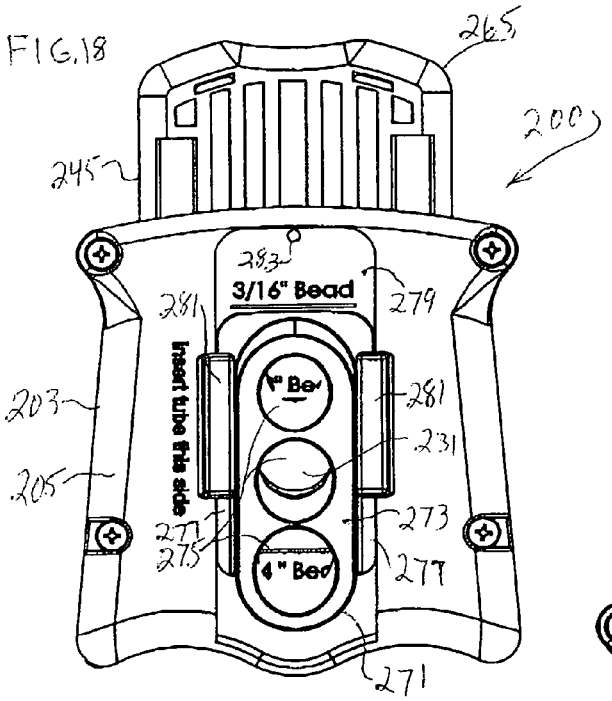
FIGS. 17 through 19 are side plan views illustrating cut opening size adjustment utilizing the opener of FIG. 7.
Figure 19:
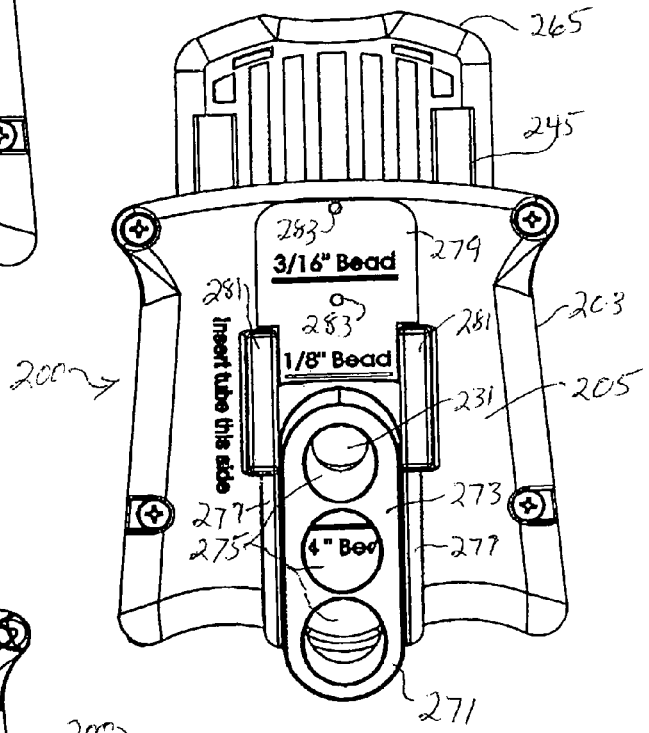
Figure 17:
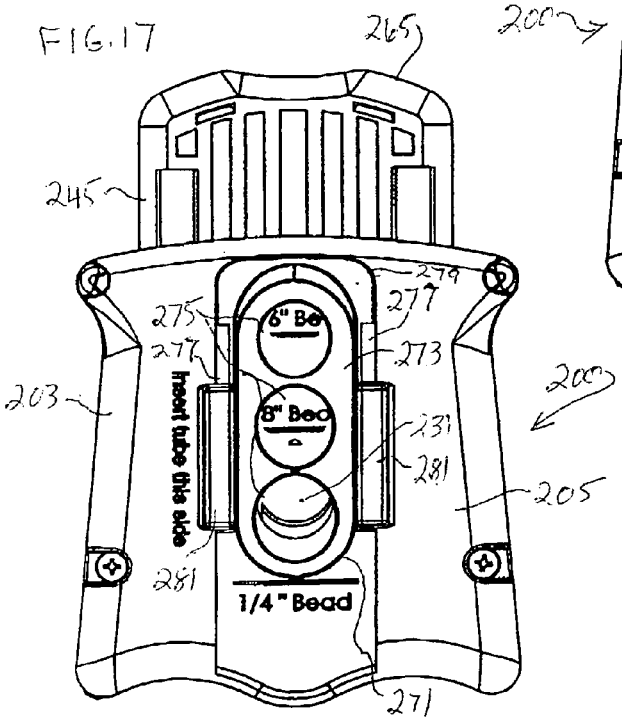

Similar to opener 11, opener 200 is embodied in a housing 203 having a much more compact form factor. Housing 203 is defined by housing sections 205 and 207, housing section 207 having first and second case portions 209 and 211. The housing sections are secured by a combination of the form fitted and matable outer engaging peripheries of the housing sections (see FIGS. 13 and 14) and any suitable means such as mechanical snaps or, as shown, threaded connectors 213, case portion 211 stabilizing case portion 209 at overlapping lips 214 (FIG. 12). As shown in FIGS. 10, 13, 14 and 16, first and second passageways 215 and 217, respectively, are defined through housing 203 by the housing sections 205 and 207, the passageways meeting at intersection 219 within the housing (see FIGS. 10 and 16). Passageway 215 intersects passageway 217 at a selected angle to accommodate angled cutting of dispensing tip 15 (in the range of from 15° to 80° depending on unit design, and preferably about 45° as shown herein).

Figure 7:
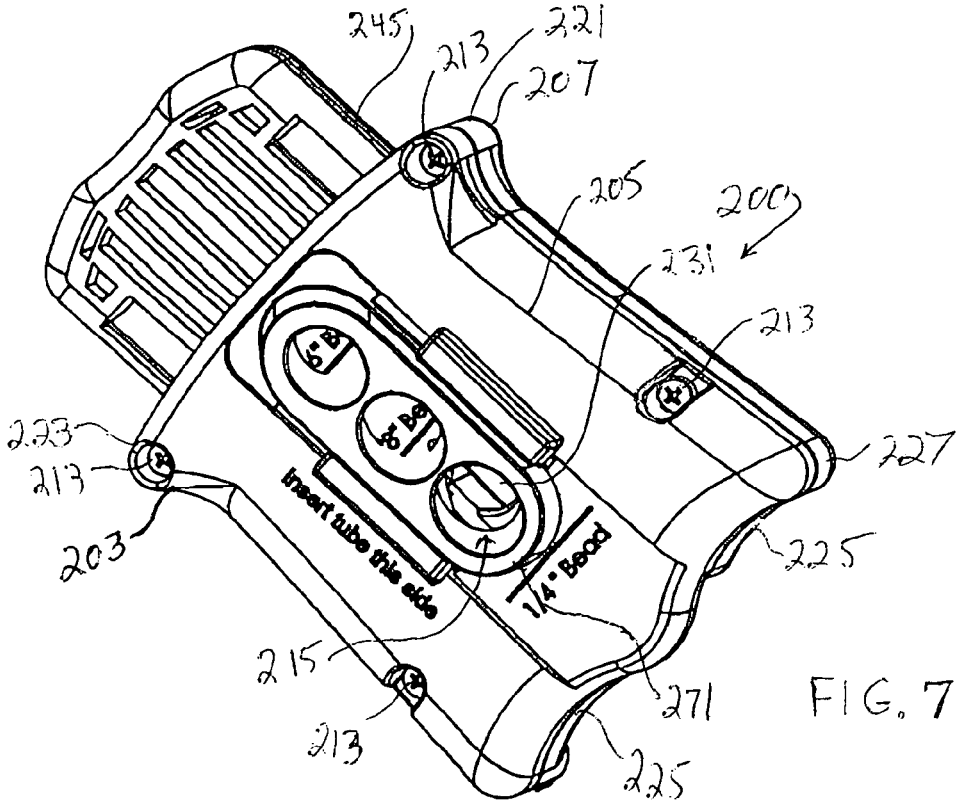
FIG. 7 is a perspective view of a second, and now preferred, embodiment of the compact dispensing tube opener of this invention.
Figure 8:
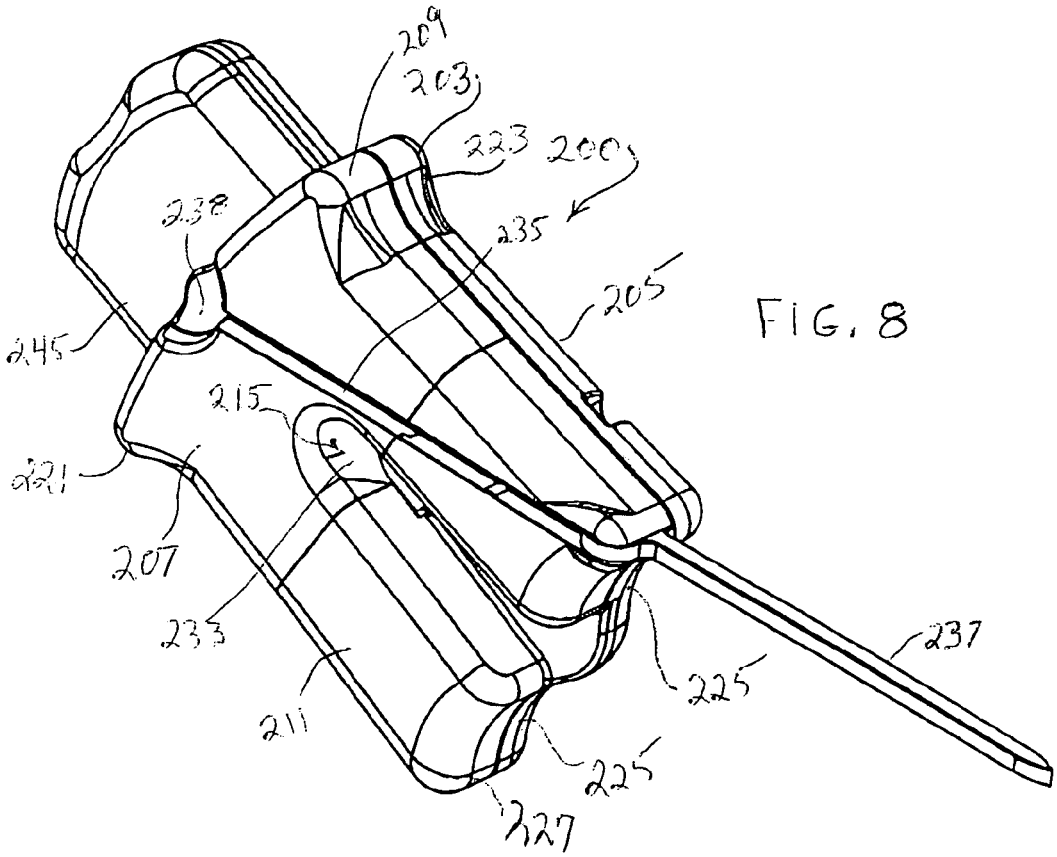
FIG. 8 is a reverse perspective view of the opener of FIG. 7.
Figure 9:
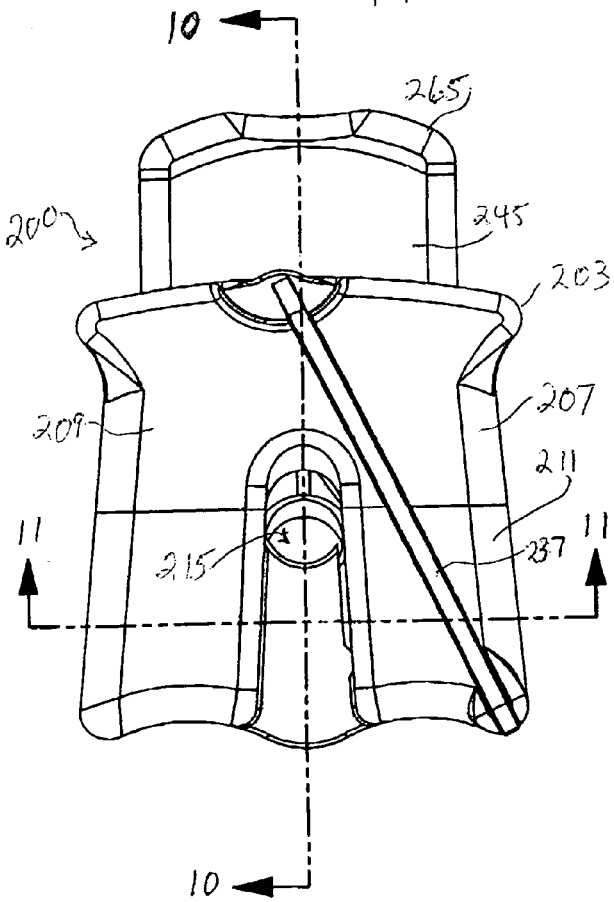
FIG. 9 is a side plan view of the opener of FIG. 7.
Figure 10:
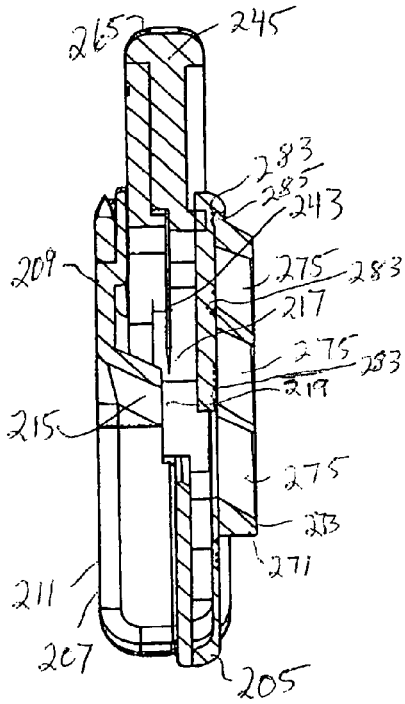
FIG. 10 is a sectional view taken through section lines 10-10 of FIG. 9.
Figure 11:
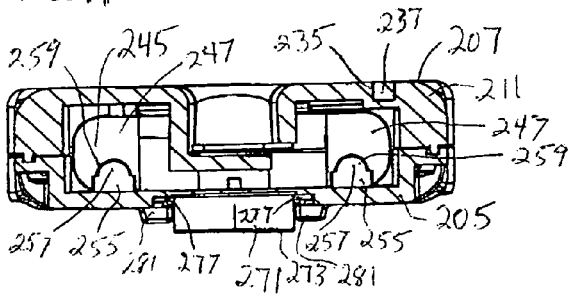
FIG. 11 is a sectional view taken through section lines 11-11 of FIG. 9.

As with the prior embodiment, the length of span of passageway 215 is selected to receive a selected length of dispensing tip 15 therethrough and stabilize the dispensing tip at a cutting location at intersection 219 (see FIG. 16). As shown in FIGS. 7 and 8, both housing sections 205 and 207 are configured to provide finger engageable housing extensions 221 and 223 at each side of housing 203 and finger contours 225 at end 227. The extensions and contours are selectively engageable by a user's finger during use as best suits the need of the user during cutting operations. Openings 231 and 233 from housing 203 (at each end of passageway 215) allow movement of dispensing tip 15 through the passageway.

Channel 235 (FIG. 8) is defined transversely across the exterior of case portions 209 and 211 for storage of pivotably deployable lance 237 (for puncturing foil seal 201) when not in use and has recess 238 at one end thereof for ease of lance deployment. The crosswise storage and deployment of lance 237 allows the lance significant length while maintaining the compact form factor of the overall opener 200. Lance 237 includes integral pivot 239 held at a hub structure (see FIGS. 13 and 14) formed by structure at each of housing sections 205 and 207 (at case portion 211).

As shown in FIGS. 11 through 14, a blade guide surface 241 is defined at housing section 207 adjacent to intersection 219. Cutting utility 243 (a replaceable blade, preferably a standard 1.98" blade) is mounted in slideable blade carriage (or housing) 245 for linear movement along passageway 217 in housing 203. Blade housing 245 includes matable blade retaining sections 247 and 249 (releasably held together by friction fit for ease of blade replacement), with section 247 including a blade contoured detent 251 at one end with blade retaining pegs (not shown) receivable at the standard blade stabilizing notches 252 found in most such blades 243 for retaining blade 243 therein (section 249 having a similar retention structure thereat—see FIGS. 12 and 13).

Slide guides 255 at housing section 205 preferably have contoured upper surfaces with spring stops 257 at one end thereat and are receivable in slide slots 259 of blade housing section 247 to guide travel of the blade housing without binding during use of the opener. Slide slots 259 each include an arcuate spring retaining detent with a spring stop 260 therein. Blade housing 245 has a central guide slot 261 defined therein by sections 247 and 249 to further guide housing travel at abutment 263 defined at housing section 207. A user contactable (i.e., manually accessible) end 265 of blade housing 245 defines a plunger/actuator which extends from housing 203 at one end thereof (opposite end 227).

Return springs 267 are held in slots 259 and are compressible between stops 257 and 260 when the housing is assembled biasing the blade housing toward a return position (fully extended from the housing) after manual movement of housing 245 to cause travel of blade 243 across passageway intersection 219 for dispenser tip cutting.

Turning now to FIGS. 11 and 16 through 19, slidable tip locator 271 is provided for user adjustment of the dispenser tip opening size (and thus size of the bead of dispensed material) by controlling the extent of the tip length allowed into passageway 215. Locator 271 includes a raised body 273 having plural angled passages 275 therethrough (each selectively forming a terminus of passageway 215 when positioned thereat). Opposite side lips 277 are slidably received between housing section 205 upper surface detent 279 and retainer elements 281 integrally formed adjacent to upper surface 279. Precise position location is accommodated by detents 283 at surface detent 279 and matable raised protuberance 285 at the bottom surface of locator 271 (see also FIG. 10).

Each of the three (fewer or more could be utilized) angled passages 275 has a different selected diameter. The diameters are selected to allow passage to a selected extent of tip 15 of a standard dispenser 13 into opener 200 when locator 271 is slid into position to bring the selected passage 275 into correspondence with opening 231 to passageway 215. By controlling the effective length of the tip allowed in passageway 215, opening size at tip 15 when cut is controlled (see FIG. 16). Various visual cues are imprinted (printed, molded in, or etched, for example) on opener 200 adjacent to locator 271 to aid the user. Upon engagement (as shown in FIG. 16) of protuberance 285 with each of the opposing selected detents 283, different tip locations are achieved at intersection 219 (due to the different passage 275 diameters), thus defining different cutting locations along the length of an inserted dispensing tip 15 (for tips of the same size) and, therefore, different expelled material bead size.

Opener 200 is preferably of a size selected so that the opener fits in the palm of the user's hand with the slim design allowing the opener to be carried comfortably in the user's pocket. Dimensions of opener 200 are preferably about 4" in length with blade housing 245 fully extended from housing 203, 2.75" wide and 1" deep. The entire construction, except for blade 243, is preferably plastic thereby reducing tool weight.

As may be appreciated, the angle of cut made be the openers of this invention depends upon the angle of intersection of elongated passageways 29 and 31 (opener 11) or passageways 215 and 217 (opener 200). Thus various models of the openers configured to accommodate different cutting angles could be provided to allow cut angles (from 15° to 80°, for example). With respect to the first embodiment, an opener could be configured having two housings, each housing a different one of the passageways, and pivotably connected with each other and indexed, at the passageways' intersection for user setting of angle of cut.

What is claimed is:

1. A compact dispensing tube opener for accessing contents of a dispensing tube having a tip that requires cutting to allow dispensing of material from the tube, said opener comprising:

a housing defining first and second passageways intersecting at an angle in said housing, said first passageway for receiving and stabilizing a selected length of the dispensing tip therein;

a blade carriage slidable relative to said housing along said second passageway and including a blade receiving end maintained substantially entirely within said housing and a manually accessible portion extending from said housing; and a tip locator movably retained at said housing adjacent to said first passageway and including plural angled passages defined therethrough, each of said passages having a different diameter and selectively movable into correspondence with said first passageway thereby accommodating stabilization of the dispensing tube tip at different user selected cutting locations along the length of the dispensing tube tip.

2. The opener of claim 1 wherein said intersecting angle of said passageways in said housing is less that 90°.

3. The opener of claim 1 wherein the dispensing tube includes an inner seal, said opener further comprising a lance pivotably mounted at said housing for puncturing the seal, said housing including a transverse channel extending crosswise in one side of said housing, said lance including a pivot and said housing including a hub together configured so that said lance is pivotable into and out of said channel.

4. The opener of claim 1 wherein said tip locator is movably retained adjacent to a first opening of said first passageway of said housing and wherein an extended segment of said first passageway is defined by any selected one of said plural angled passages defined through said tip locator when moved into correspondence with said first opening of said first passageway.

5. The opener of claim 1 wherein said housing includes a surface between spaced retainer elements, said locator slidable between said retainer elements at said surface.

6. The opener of claim 5 wherein at least one of said housing and said surface includes visual cues thereon adjacent to said locator for aiding a user in operation of said locator.

7. The opener of claim 1 further comprising a return spring located in said housing adjacent to said blade carriage.

8. The opener of claim 1 wherein said second passageway of said housing has at least a first slide guide adjacent thereto, and wherein said carriage has at least a first guide for slidable movement of said slide guide of said housing thereat.

9. A compact dispensing tube opener for accessing contents of a dispensing tube having a tip that requires cutting to allow dispensing of material from the tube, said opener comprising:

a housing defining first and second passageways intersecting at an angle in said housing, said first passageway for receiving and stabilizing a selected length of the dispensing tip therein and said second passageway having at least a first slide guide adjacent thereto, said housing including first and second opposite ends with said second end configured with spaced finger contours thereat;

a blade carriage having at least a first guide for slidable movement of said slide guide of said housing thereat, said carriage including a blade receiving end maintained substantially entirely within said housing and a manually accessible portion extendible through said first end of said housing; and a tip locator slidably maintained at said housing adjacent to said first passageway and having plural angled passages therethrough each with a different diameter and selectively movable into correspondence with said first passageway.

10. The opener of claim 9 wherein said locator includes a protuberance thereat and wherein said housing includes a plurality of detents, correspondence of said passages being registered by engagement of said protuberance at a selected detent.

11. The opener of claim 9 wherein said housing includes a transverse channel extending crosswise in one side of said housing, said opener further comprising a lance pivotably mounted at said housing and pivotable into and out of said channel.

12. The opener of claim 9 wherein said housing includes a surface between spaced retainer elements, said tip locator slidable between said retainer elements at said surface.

13. The opener of claim 9 wherein said carriage includes first and second blade retaining sections for replaceable securement of a standard sized blade therebetween.

14. The opener of claim 9 further comprising a spring mounted between a first stop at said housing and a second stop adjacent to said guide of said carriage.

15. The opener of claim 9 wherein said guide of said blade carriage is a slot.

16. A compact dispensing tube opener for accessing contents of a dispensing tube having a tip that requires cutting to allow dispensing of material from the tube, said opener comprising:

a housing defining first and second passageways intersecting at an angle in said housing, said first passageway for receiving and stabilizing a selected length of the dispensing tip therein and said second passageway having at least a first slide guide adjacent thereto, said housing including first and second opposite ends with said second end configured with spaced finger contours thereat, a transverse channel extending crosswise in one side of said housing;

a blade carriage having at least a first guide for slidable movement of said slide guide of said housing thereat, said carriage including a blade receiving end maintained substantially entirely within said housing and a manually accessible portion extendible through said first end of said housing; and a lance pivotably mounted at said housing and pivotable into and out of said channel.

17. The opener of claim 16 wherein said blade receiving end of said carriage is configured to receive and retain a standard sized cutting blade.

18. The opener of claim 16 wherein said first slide guide of said housing includes a stop and wherein said guide of said carriage includes a stop, said opener further comprising a return spring held between said stops when said opener is assembled.

19. The opener of claim 16 wherein said housing includes a second slide guide adjacent to said second passageway and spaced from said first slide guide, and wherein said blade carriage includes a second guide for slidable movement of said second slide guide of said housing thereat.

20. The opener of claim 16 further comprising a return maintained in said housing and operatively associated with said carriage for returning said carriage to a position wherein said blade receiving end is substantially withdrawn from an intersection of said passageways.

* * * * *